US006457849B2

(12) United States Patent
Tsukamoto

(10) Patent No.: US 6,457,849 B2
(45) Date of Patent: Oct. 1, 2002

(54) VEHICLE HEAD LAMP

(75) Inventor: Michio Tsukamoto, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/789,137

(22) Filed: Feb. 20, 2001

(30) Foreign Application Priority Data

Feb. 21, 2000 (JP) ..... 2000-043392

(51) Int. Cl.[7] ..... F21V 1/00

(52) U.S. Cl. ..... 362/509; 362/382; 362/464; 362/512; 362/539

(58) Field of Search ..... 362/509, 514, 362/516, 517, 464, 465, 466, 467, 282, 319, 512, 515, 283, 284, 539

(56) References Cited

U.S. PATENT DOCUMENTS 4,760,499 A * 7/1988 Ryou, II ..... 362/282
5,213,406 A 5/1993 Neumann et al. ..... 362/61
6,059,435 A * 5/2000 Hamm et al. ..... 362/284
6,179,455 B1 * 1/2001 Taniuchi ..... 362/280

FOREIGN PATENT DOCUMENTS

GB 2 332 742 A 6/1999
GB 2 345 747 A 7/2000

* cited by examiner

*Primary Examiner*—Sandra O'Shea
*Assistant Examiner*—John Anthony Ward
(74) *Attorney, Agent, or Firm*—Rosenthal & Osha L.L.P.

(57) ABSTRACT

A vehicle head lamp for irradiating a light from a light source, the vehicle head lamp includes: a main reflector for reflecting the light from the light source; a sub-reflector movable in a first position and a second position, wherein the sub-reflector forwardly reflects the light from the light source when the sub-reflector is in the first position, and the sub-reflector is inhibited from forwardly reflecting the light from the light source when the sub-reflector is in the second position; and a driving unit connecting to the sub-reflector to make the sub-reflector move between the first position and the second position.

15 Claims, 9 Drawing Sheets

VEHICLE HEAD LAMP

This patent application claims priority from a Japanese patent application No. 2000-043392 filed on Feb. 21, 2000, the contents of which are incorporated herein by reference.

BACKGROUND OF THE INVENTION

1. Field of the Invention

This invention relates to a vehicle head lamp. More specifically, this invention relates to a vehicle head lamp in which movements of an element of the vehicle head lamp switch over light distribution patterns.

2. Description of the Related Art

A vehicle head lamp irradiates a low beam or a high beam such that a reflector reflects forwardly a light from a light source. Because different light distributions are required between the low beam and the high beam, two light sources provided with a light bulb or two light bulbs are commonly used. In these cases, the switching over the low beam and the high beam is achieved by alternating the turning on one light source (or bulb) and the other.

It is also commonly used that a vehicle head lamp in which the beam switching is carried out by use of a single light source. Such constitution may be required, especially in a two-beam vehicle head lamp which uses a discharge bulb serving as the light source bulb. In the vehicle head lamp having the single light source, it is necessary to switch over beams by moving an element of the vehicle head lamp.

By one of common ways, the beam switching is achieved by moving a movable shade. In this case, a shade driving unit 102 makes the movable shade 104 move to two predetermined positions where the shade 104 shades different amounts of light from the light source 106 to a reflective surface 108*a* of the reflector 108, as shown in FIG. 8.

The beam switching using the movable shade 104 requires a high beam sole region A(H) having a certain area in the reflective surface 108*a* of the reflector, that is a reflecting region outer the one dot chain line in FIG. 9. Accordingly, the reflective surface region A(L), namely the reflecting region inner the one dot chain line in FIG. 9, which is applied to the low beam must become small. Therefore, here is a problem that the light intensity of light in the low beam can be reduced.

This problem may occur not only in switching over the low and high beams by moving the movable shade but generally in changing the light distributions also by moving the movable shade.

SUMMARY OF THE INVENTION

Therefore, it is an object of the present invention to provide a vehicle head lamp, which is capable of overcoming the above drawbacks accompanying the related art.

It is further object of the present invention to provide a vehicle head lamp, in which the light distribution is changed by moving the element of the vehicle head lamp and the beam irradiations are obtained with sufficient intensities wherever the element is positioned.

The above and other objects can be achieved by combinations described in the independent claims. The dependent claims define further advantageous and exemplary combinations of the present invention.

According to the first aspect of the present invention, a vehicle head lamp for irradiating a light from a light source, the vehicle head lamp comprises: a main reflector for reflecting the light from the light source; a sub-reflector movable in a first position and a second position, wherein the sub-reflector forwardly reflects the light from the light source when the sub-reflector is in the first position, and the sub-reflector is inhibited from forwardly reflecting the light from the light source when the sub-reflector is in the second position; and a driving unit connecting to the sub-reflector to make the sub-reflector move between the first position and the second position.

According to the second aspect of the present invention, a vehicle head lamp attached to a vehicle which has a steering operation, the vehicle head lamp comprises: a right head lamp for irradiating a light from a light source including, a main reflector for reflecting the light; a sub-reflector movable in a first position and a second position, wherein the sub-reflector forwardly reflects the light from the light source when the sub-reflector is in the first position, and the sub-reflector is inhibited from forwardly reflecting the light from the light source when the sub-reflector is in the second position, and a driving unit connecting to the sub-reflector to make the sub-reflector move between the first position and the second position; and a left head lamp for irradiating a light from a light source including, a main reflector for reflecting the light, a sub-reflector movable in a first position and a second position, wherein the sub-reflector forwardly reflects the light from the light source when the sub-reflector is in the first position, and the sub-reflector is inhibited from forwardly reflecting the light from the light source when the sub-reflector is in the second position, and a driving unit connecting to the sub-reflector to make the sub-reflector move between the first position to the second position.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
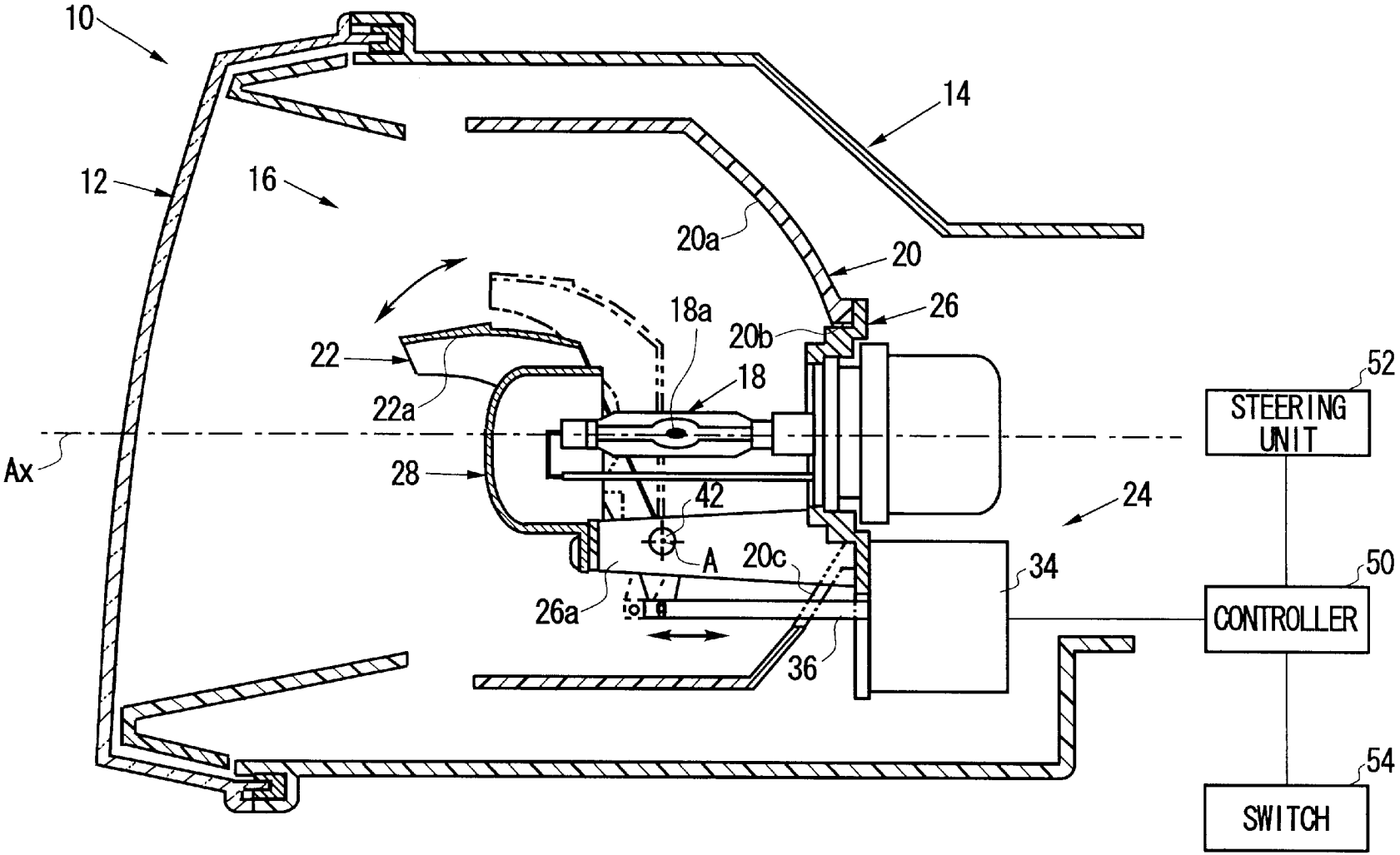
FIG. 1 shows a side sectional view of a vehicle head lamp according to an embodiment of the present invention.
Figure 2:
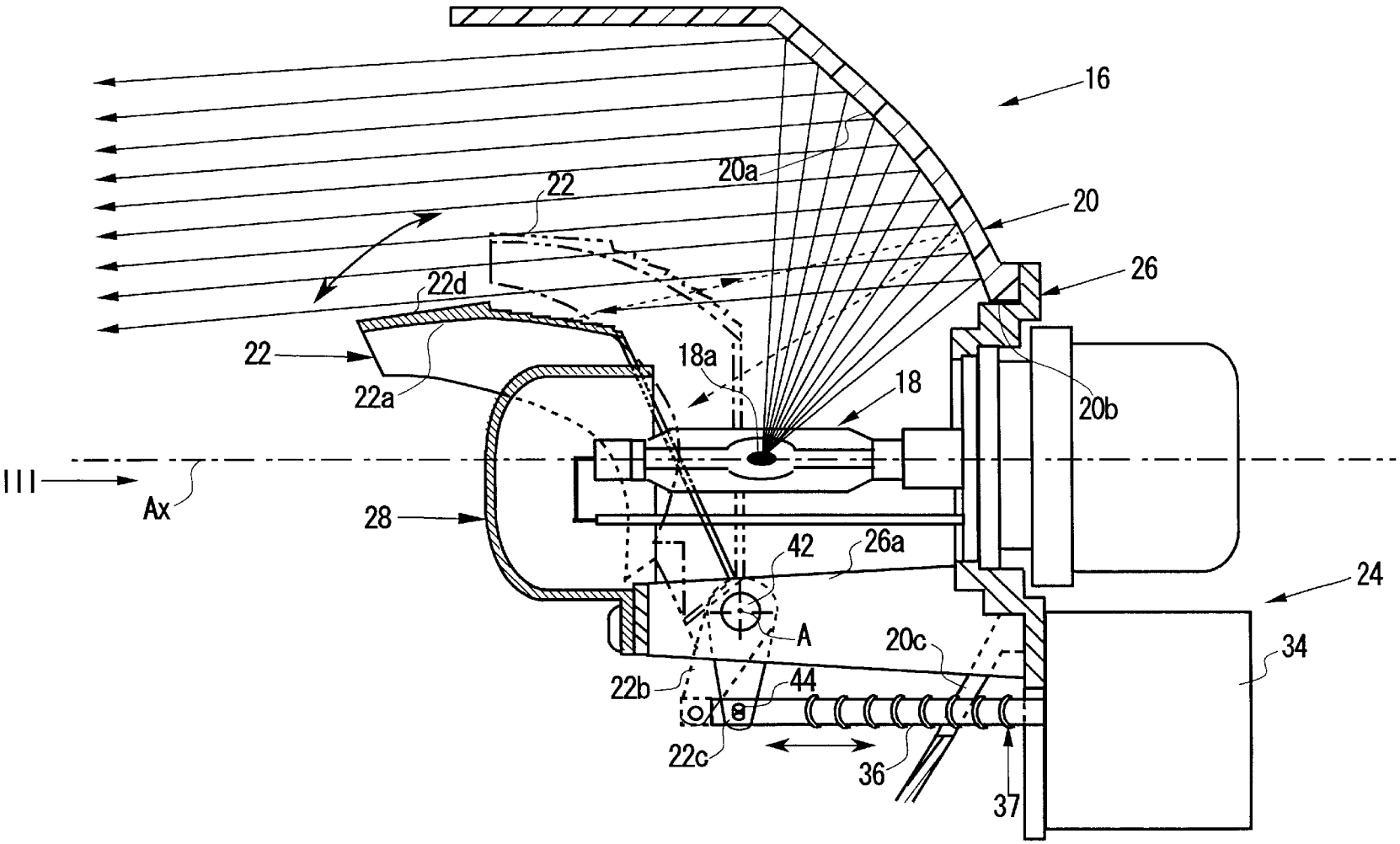
FIG. 2 shows an enlarged view in section of FIG. 1.
Figure 3:
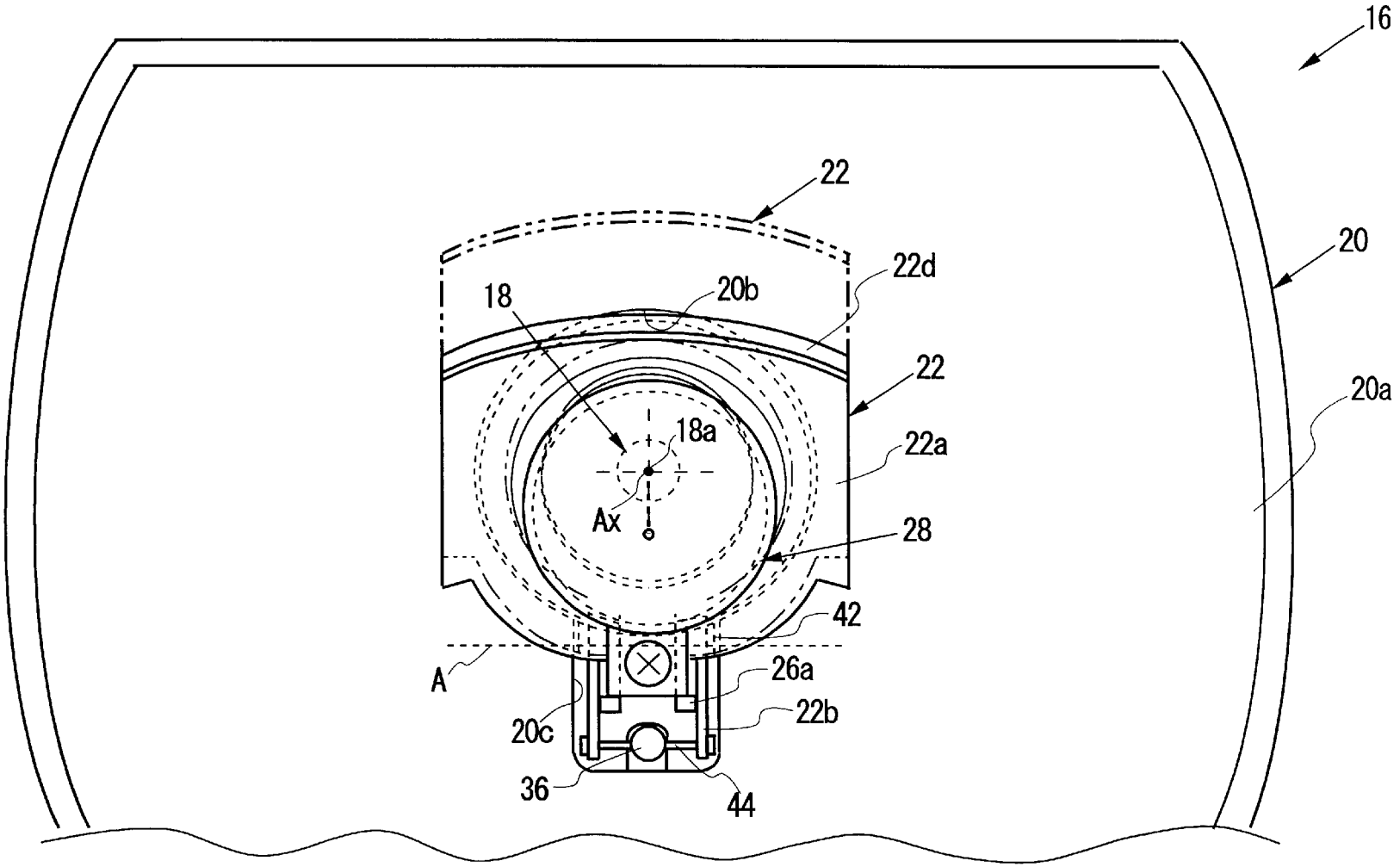
FIG. 3 shows a directional view from the arrow III shown in FIG. 2.

FIG. 1 shows a side sectional view of a vehicle head lamp according to an embodiment of the present invention. FIG. 2 shows an enlarged view in section of FIG. 1. FIG. 3 shows a directional view from the arrow III shown in FIG. 2.

As shown in FIGS. 1 to 3, a vehicle head lamp 10 according to an embodiment of the present invention has a reflector unit 16 which is installed inside a lamp room comprising a clear cover 12 and a lamp body 14 such that the reflector unit 16 is able to incline in vertical and horizontal directions with an aiming mechanism not shown.

The reflector unit 16 has a discharge lamp 18, which is a metal halide lamp in this embodiment, a main reflector 20, a sub-reflector 22, a reflector driving unit 24, a bulb supporting base 26, and a stationary shade 28.

In this embodiment, the clear cover 12 may be plain transparent since the reflector unit 16 has a function to control the light distribution.

More specifically, the main reflector 20 of the reflector unit 16 has a reflective surface 20*a* to forwardly reflect a light from a discharge emitting portion 18*a* serving as the light source of the discharge bulb 18. The diffusion or directive reflecting function by the reflective surface 20*a* makes a beam having the light distribution pattern for the low beam be emitted in the forward direction. Furthermore, the sub-reflector 22 of the reflector unit 16 has a reflective surface 22*a* which is able to forwardly reflect the light from the discharge emitting portion 18*a*. The more detail thereof is described later.

The discharge bulb 18 is fixed to and supported by the main reflector 20 with a bulb supporting base 26. The bulb supporting base 26, which is inserted into a rear top opening 20*b* of the main reflector 20 from backward thereof, is fastened with screws to plural bosses, not shown, provided with a back side of the reflector 20. The discharge bulb 18 is fixed to and supported by the bulb supporting base 26 with a wire spring. Under these circumstances, the discharge emitting portion 18*a* of the discharge bulb 18 is positioned onto an optical axis Ax of the main reflector 20.

A rectangle opening 20*c* communicating with the rear top opening 20*b* is formed at the lower portion of the rear top opening 20*b* of the reflective surface 20*a* of the main reflector 20. A bracket 26*a*, which forwardly projects through the rectangle 20*c*, is formed at the lower portion of the bulb supporting base 26 below the optical axis Ax. The stationary shade 28 is fastened with a screw at the tip of the bracket 26*a*.

The reflector driving unit 24 has a solenoid 34 which is fixed with a screw to the back side of the bulb supporting base 26 below the optical axis Ax, and a return spring 37 which is attached to a movable core 36 of the solenoid 34 and urges the movable core toward a no-exciting position. The movable core 36 forwardly extends through the rectangle opening 3*c*. A position where the movable core 36 advances is an exciting position, while a position where the movable core 36 retreats is the no-exciting position. Accordingly, if the reflector driving unit 24 gets out of order, the movable core 36 is maintained to the no-exciting position and therefore, the sub-reflector 22 is kept to a low beam forming position described later, so that a fail safe is achieved thereby.

A controller 50 connects to the reflector driving unit 24 so as to control the reflector driving unit 24. A switch 54 connects the controller 50 so that a driver or user is able to give instructions to the controller 50 for switching over between the high and low beams by manually operating the switch 54.

The sub-reflector 22, which is relatively small dimension, surrounds the discharge bulb 18 in part around the optical axis Ax. At the lower portion of the sub-reflector 22, a pair of right and left stays 22*b* are provided. At the upper portions of the stays 22*b*, the sub-reflector 22 is supported by the bracket 26*a* of the bulb supporting base 26 with a pivot 42 such that the sub-reflector 22 is pivotable around an axis A horizontally extending. At the lower portions of these stays 22*b*, the sub-reflector 22 engages with the tip of the movable core 36. Namely, a pin 44 horizontally extending at the tip of the movable core 36 is inserted into slots 22*c* vertically extending at the lower portions of the right and left stays 22*b*. Although the distance between the pivot 42 and the pin 44 varies in accordance with the pivot movement of the sub-reflector 22, the change of the distance is absorbed by sliding the pin 44 within the slots 22*c*.

Figure 4B:
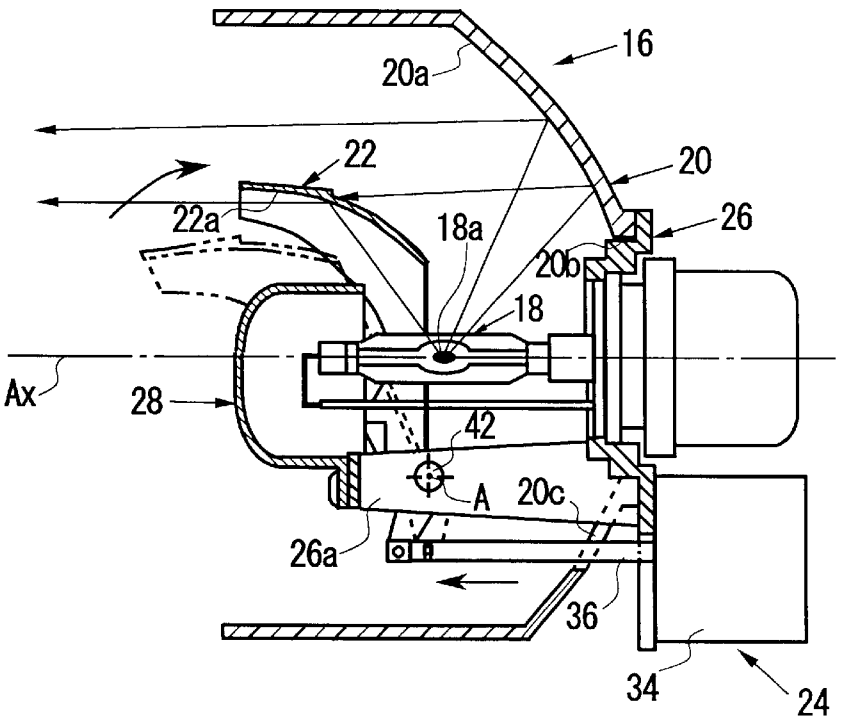
FIGS. 4A and 4B show side sectional views of the vehicle head lamp in which low and high beams are switched over by a reflector driving unit.
Figure 4A:
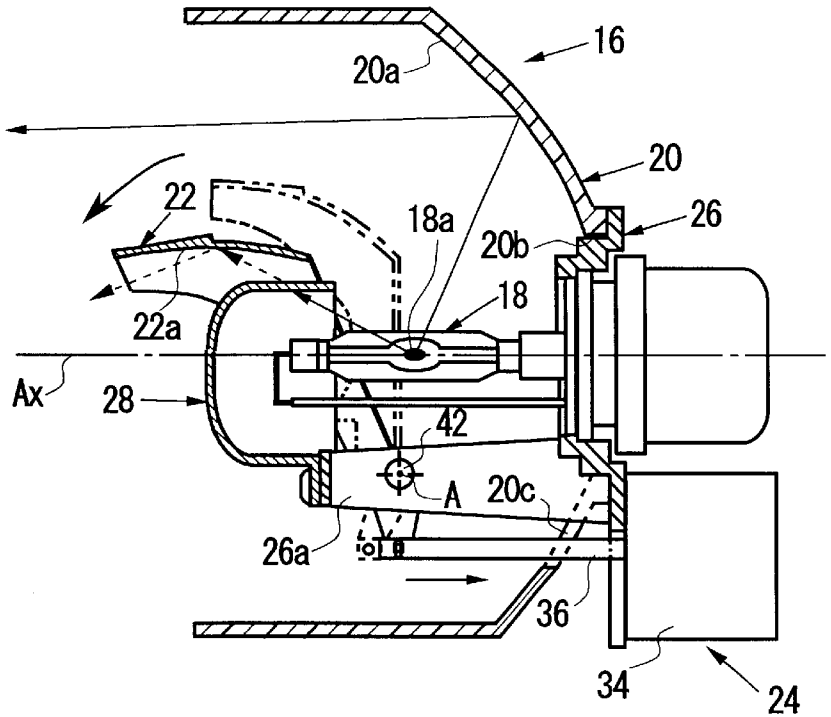

The sub-reflector 22 is pivoted around the axis A by the reflector driving unit 24, so that the sub-reflector 22 takes either the low beam forming position as shown in FIG. 4A called a second position, or a high beam forming position as shown in FIG. 4B called a first position.

In the low beam forming position, the sub-reflector 22 forwardly inclines and therefore the reflective surface 22*a* directs downwardly, while the stationary shade 28 is intervenient between the reflective surface 22*a* and the light emitting portion 18*a*. Under this condition, the light emitted from the light emitting portion 18*a* can not be incident to the reflective surface 22*a*. In the low beam forming position, consequently, only the light reflected by the main reflector 20 is forwardly irradiated. Thus, the low beam light distribution pattern P(L) is formed as shown in FIG. 5A.

As shown in FIG. 2, a little portion of the light reflected by the main reflector 20 is incident on a back surface 22*d* of the sub-reflector 22 in the low beam forming position. If the back surface 22*d* is plane, the reflected light from the main reflector 20 is normally reflected on the plane surface and the light thus reflected by the plane surface is directed forwardly. This causes the undesirable glare light. According to the present embodiment of the invention, the back surface 22*d* of the sub-reflector 22 has steps, so that the incident light to the back surface 22*d* is reflected back to the reflective surface 20*a* of the main reflector 20, and the light thus reflected by the reflective surface 20*a* is directed downward, as shown in a chain line of FIG. 2. The glare light is prevented thereby.

On the other hand, the sub-reflector 22 stands up in the high beam forming position, as shown in FIG. 4B. This condition allows the light from the light emitting portion 18*a* to be incident to the reflective surface 22*a* of the sub-reflector 22. The standing up position of the sub-reflector 22 slightly precedes the reflective surface 20*a* of the main reflector 20, in order to prevent from blocking the light incident from the light emitting portion 18*a* to the reflective surface 20*a* of the main reflector 20. The diffusion or directive reflecting function of the reflective surface 22*a* of the sub-reflector 22 makes a beam having the additional light distribution pattern P(H) for the high beam be emitted in the forward direction, as shown in FIG. 5B. The high beam light distribution pattern is resulted by the combination of the additional light distribution pattern P(H) made by the light from the sub-reflector 22 and the light distribution pattern P(L)' made by the light from the main reflector 20.

Figure 5A:
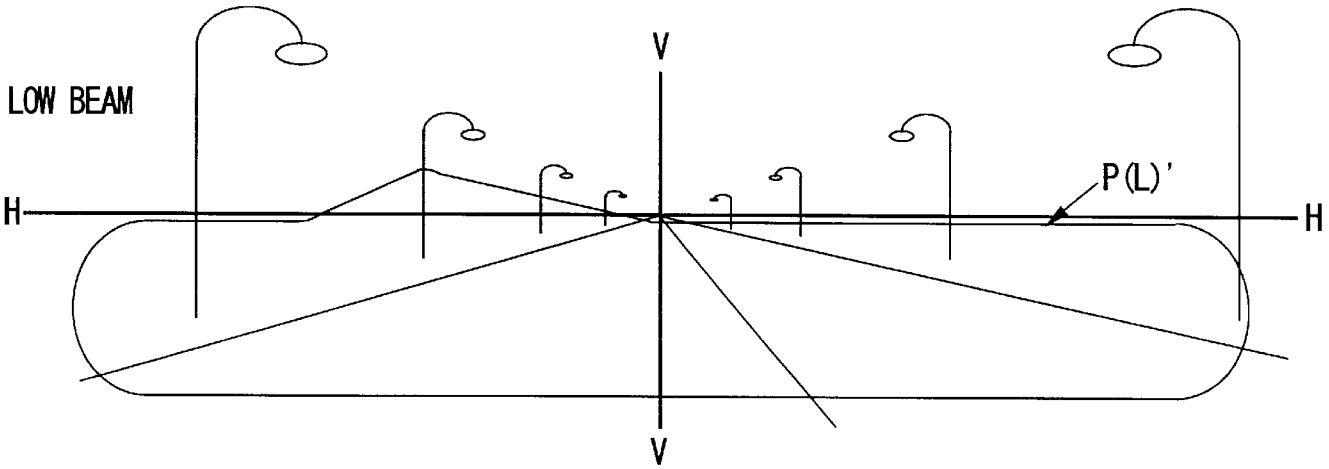
FIGS. 5A and 5B show light distribution patterns formed by the vehicle head lamp.
Figure 5B:
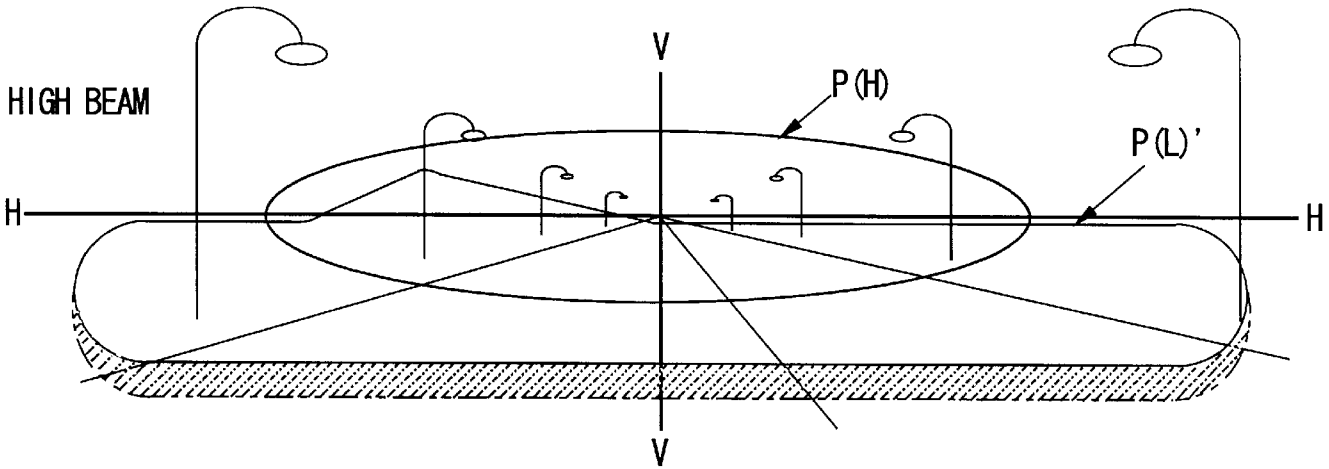

The light distribution pattern P(L)' formed by the light reflected by the main reflector 20 is cut a lower portion away, that is, an area of two dots chain line in FIG. 5B, as comparing with the light distribution pattern P(L) shown in FIG. 5A. The reason thereof is that the sub-reflector 22, which is standing up, shades the light reflected by the center region of the reflective surface 20*a* of the main reflector 20. Indeed, the forward irradiation light declines of the shaded portion. However, the irradiation light for the nearer front road surface thus cut is not important for the high beam light distribution pattern. Furthermore, the additional light distribution pattern P(H) which is added involves the light intensity extremely larger than that of the cut light and is irradiated more far. Accordingly, the light distribution pattern for the high beam thus formed improves the faraway visibility, which is not too much strong irradiation to the road surface of the near front of the vehicle.

As described above, the vehicle head lamp 10 according to the present embodiment of the invention has the sub-reflector 22 positioned in the forward side of the main reflector 20. The vehicle head lamp 10 makes the sub-reflector 22 move between the high beam forming position in which the sub-reflector 22 forwardly reflects the light from the light emitting portion 18*a*, and the low beam forming position in which the sub-reflector 22 do not forwardly reflect the light from the light emitting portion 18*a*. In the vehicle head lamp 10, the beam switching between the high and low beams is carried out thereby, and the following effects and advantages may be achieved.

In other words, when the sub-reflector 22 is in the high beam forming position, both of the light reflected by the sub-reflector 22 and the light reflected by the main reflector 20 are irradiated forwardly. The light from the light emitting portion 18*a*, the light which does not serves as the forward irradiation light with the main reflector 20 is applicable to the forward irradiation light by the sub-reflector 22. Accordingly, the irradiation light increases to the extent of the solid angle which made by the sub-reflector 22. On the other hand, since the sub-reflector 22 is positioned forward the main reflector 20, the light reflected by the main reflector 22 is shaded by the sub-reflector 22, so that the irradiation light decreases of the shaded light.

In the present embodiment of the invention, because the sub-reflector 22 in the high beam forming position shades the light reflected by the center region of the reflective surface 20*a* of the main reflector 20, the amount of the irradiation light increased by the sub-reflector 22 may make larger than that of the light reflected by the main reflector 20 but shaded by the sub-reflector 22. Therefore, it is able to form the light distribution pattern with the sufficient irradiation light intensity for the high beam.

Moreover, under the condition that the sub-reflector 22 shades the light reflected by the center region of the reflective surface 20*a* of the main reflector 20, the light distribution pattern P(L)' formed by the light reflected by the main reflector 20 cuts the lower portion (that is, the light which is emitted to the road surface of the near front of the vehicle and is not important for the high beam light distribution), comparing with the low beam light distribution pattern P(L). Accordingly, it is prevented that the light distribution pattern for the high beam is too much strong irradiation to the road surface of the near distance and deteriorated the faraway visibility.

On the other hand, when the sub-reflector 22 is in the low beam forming position, the light reflected by the main reflector 20 is forwarded. A portion of the light, which is incident on the back surface 22*d* of the sub-reflector 22, is extremely little. Accordingly, most of all amount of the light reflected by the main reflector 20 is emitted toward the front side of the lamp.

According to the present embodiment of the invention, in the vehicle head lamp in which the light distribution is changed by moving the element of the vehicle head lamp, the beam irradiation intensity is sufficiently obtained wherever the element is positioned.

Moreover, according to the embodiment of the invention, the stationary shade 28 which is positioned near front of the light emitting portion 18*a* shades the light from the light emitting portion 18*a* incident to the sub-reflector 22 in the low beam forming position. Accordingly, even the sub-reflector 22 is not yet moved to the position where the light from the light emitting portion 18*a* does not come, the stationary shade 28 helps blocking the sub-reflector 22 from forwardly reflecting the light from the light emitting portion 18*a*.

As shown in FIG. 4A, according to the embodiment of the invention, the sub-reflector 22 inclines forwardly in the low beam forming position and the reflective surface 22*a* thereof is directed downward. Even if no stationary shade is installed, the light reflected by the reflective surface 22*a* is significantly directed downward, therefore substantially no light from the light emitting portion 18*a* is reflected forwardly.

In any events, because the sub-reflector 22 in the low beam forming position does not contribute the light distribution function of the lamp, it is not necessary to finely control the stop positions for the beam switching. Therefore, the cost of the reflector driving unit 24 may be reduced.

Still further, according to the embodiment of the invention, the steps are formed on the back surface 22*d* of the sub-reflector 22, and prevent the light reflected by the main reflector 20 from forwardly reflecting by the back surface 22*d* when the sub-reflector 22 is in the low beam forming position. Accordingly, the undesirable irradiation, i.e. the glare light is avoided.

In order to form the steps on the back surface 22*d* of the sub-reflector 22, it is preferable to make the sub-reflector 22 of a molded synthetic resin, aluminum, or the like. Alternatively, the sub-reflector 22 may be made of a steal plate or an aluminum plate, and the back surface thereof may be subjected to an anti-reflective coating such as a black paint or a crimpled treatment which makes the surface rough. Such a black paint reduces the reflective index on the back surface in great amount. The crimpled treatment generates the diffused reflection within the lamp room. In any events, it may be prevented the back surface 22*d* from forwardly reflecting.

In this embodiment, the beam switching over high and low is carried out by the sub-reflector 22 pivoting around the axis A horizontally extending. It is not limited, and the axis A may extends either in the vertical direction or in the inclined direction. In these cases, the similar functions and advantages to this embodiment may be achieved.

Figure 6:
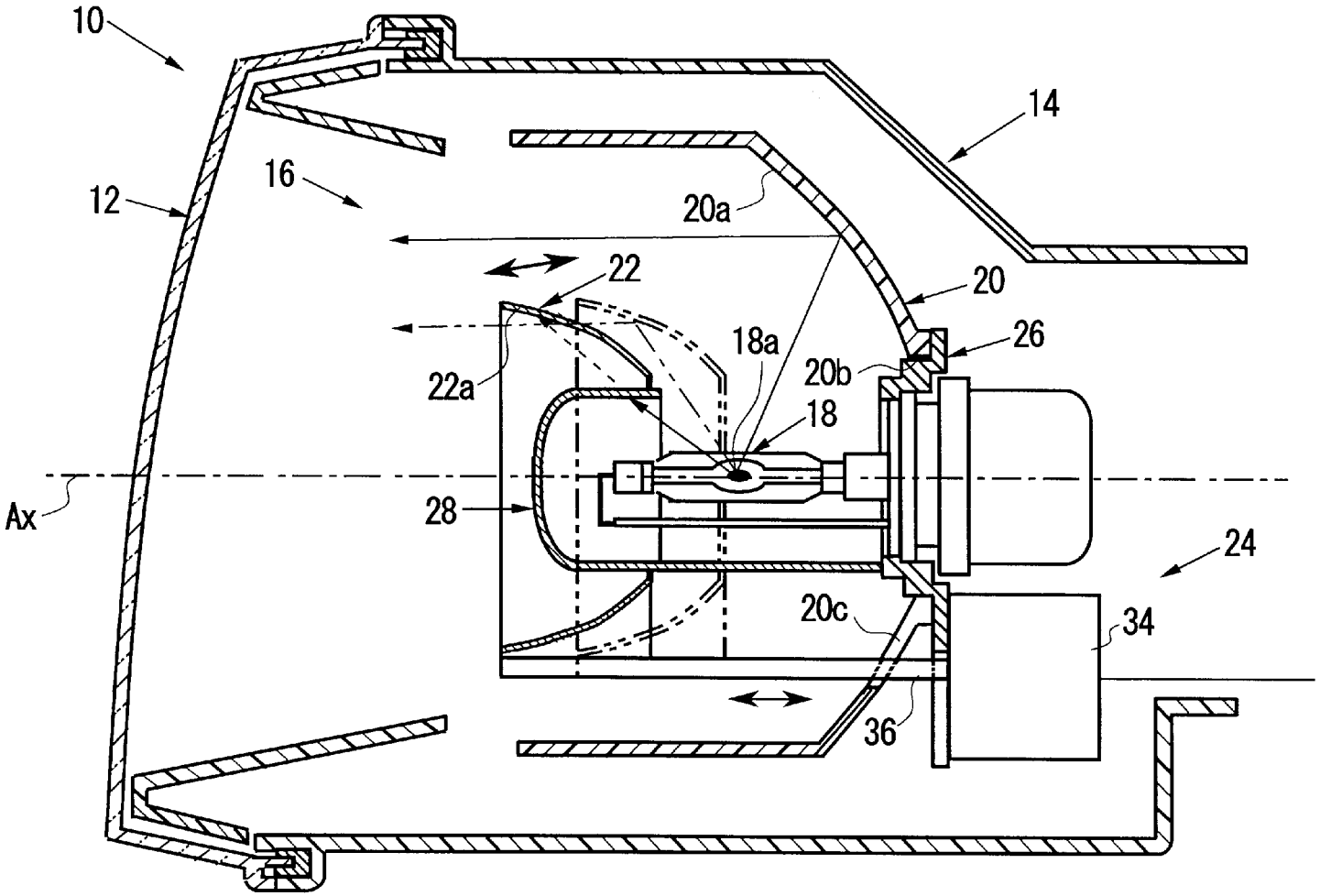
FIG. 6 shows a side sectional view of a vehicle head lamp according to another embodiment of the invention.

As shown in FIG. 6, the beam switching over high and low may be performed by linearly reciprocating the sub-reflector 22 in the fore-back direction. In this case, the sub-reflector 22 in the low beam forming position, that is, in the forwarded position, shades the light reflected by the main reflector 20 slightly more than that of the above described embodiment. Except this point, the similar functions and advantages may be obtained.

In these embodiments, both of the main reflector 20 and the sub-reflector 22 have the diffusion or directive reflecting function. Instead, these main reflector 20 and sub-reflector 22 may have respective reflective surfaces 20*a* and 22 being simple rotational parabolic surfaces, and the diffusion and directive reflecting function may be given to the clear cover 12.

The vehicle head lamp 10 according to the above described embodiments make the light distribution pattern for the high beam when the sub-reflector 22 is in the high beam forming position. Other light distribution patterns may be formed.

For instance, a pair of head lamps attached to a vehicle may be provided with as follows.

Figure 7A:
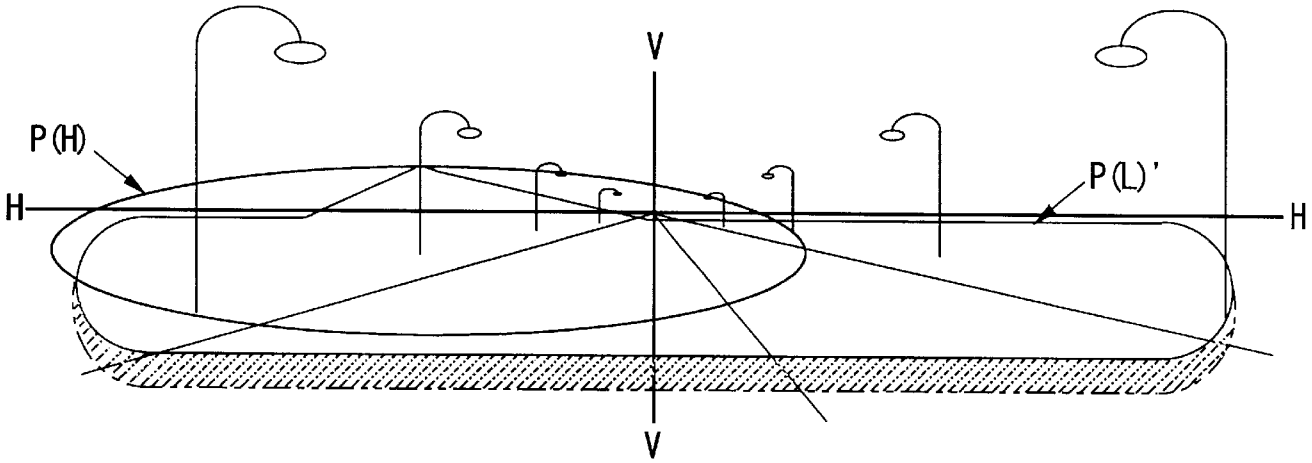
FIGS. 7A and 7B show light distribution patterns formed by the vehicle head lamp according to another embodiment.
Figure 7B:
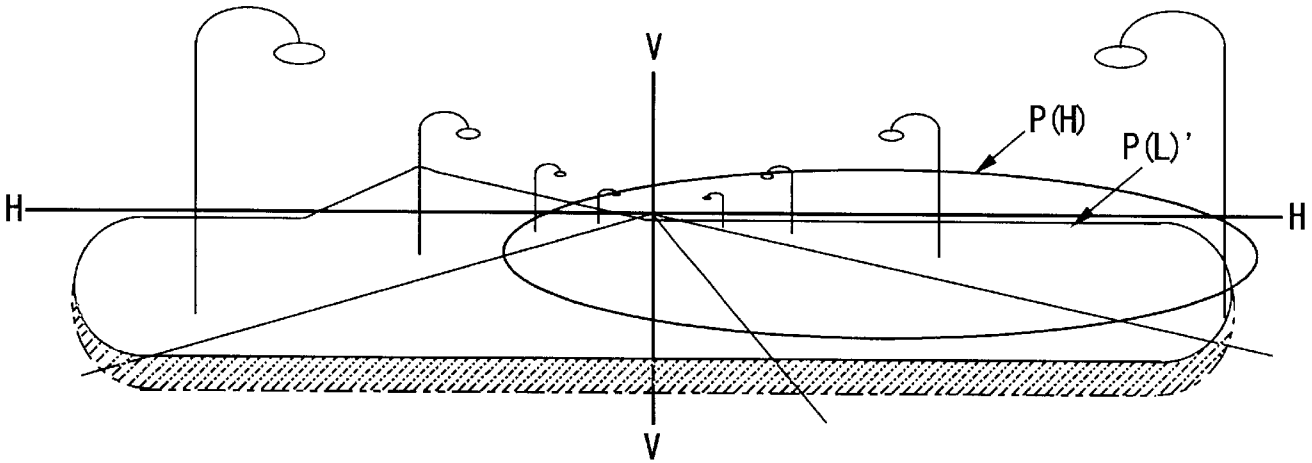
Figure 8:
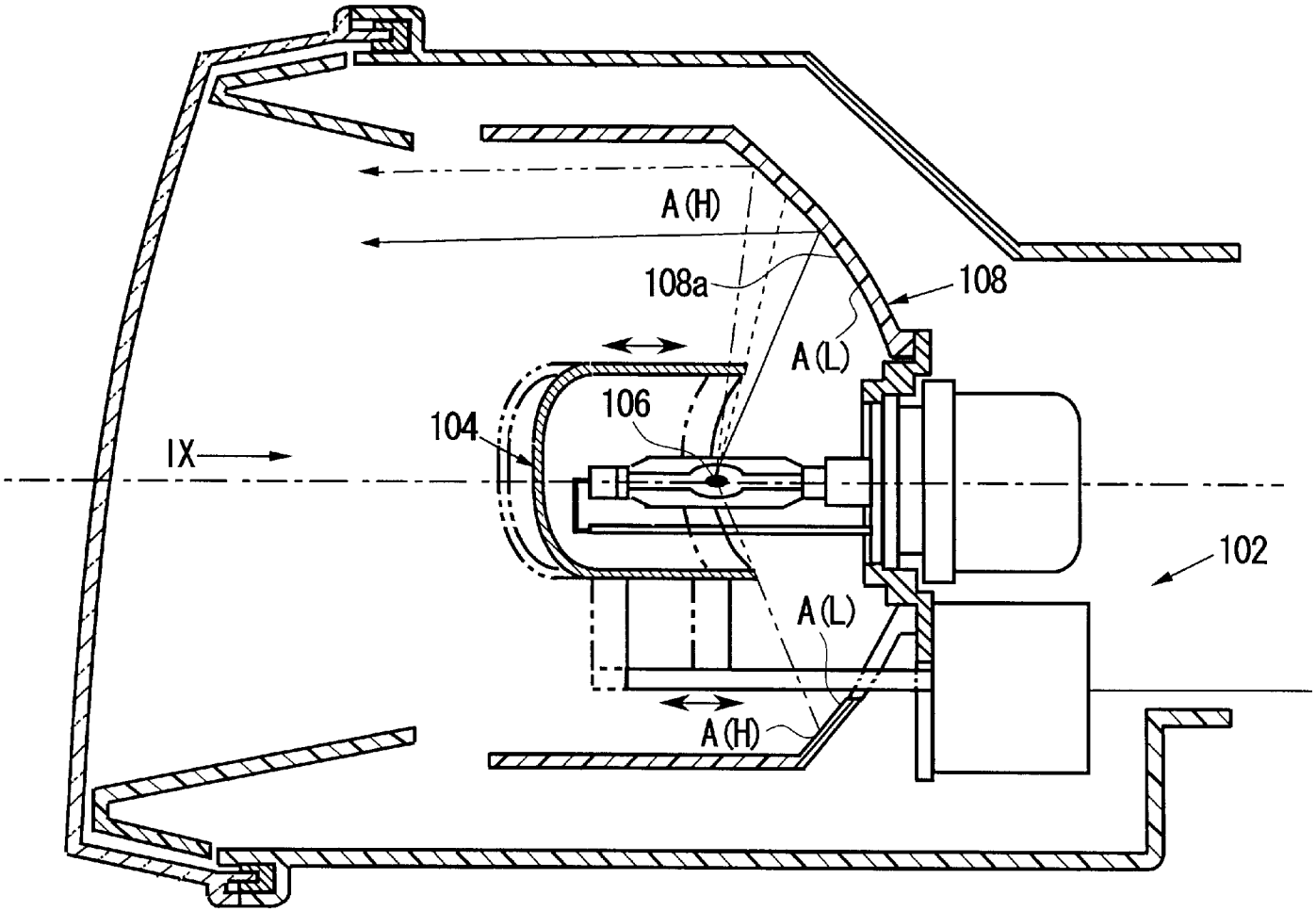
FIG. 8 RELATED ART
FIG. 8 shows a side sectional view of a vehicle head lamp in the related art.
Figure 9:
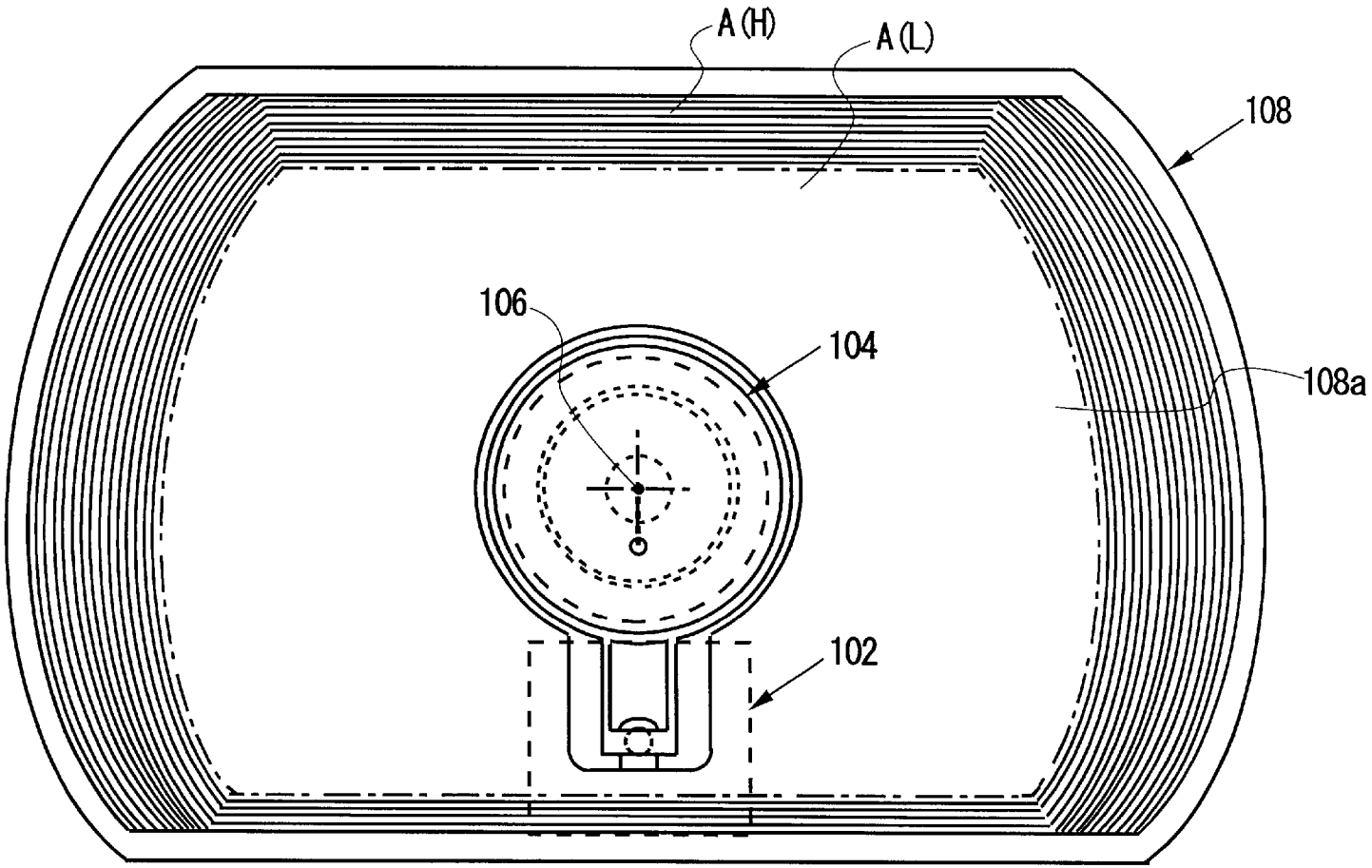
FIG. 9 RELATED ART
FIG. 9 shows a directional view from the arrow IX shown in FIG. 8.

The left lamp of the pair makes an additional light distribution pattern P(H) of light reflected by a reflective surface 22*a* of a sub-reflector 22 positioned upper left a light distribution pattern P(L)' of light reflected by the main reflector 20, as shown in FIG. 7A, when the sub-reflector 22 of the left lamp is in a high light beam forming position. On the other hand, the right lamp of the pair makes an additional light distribution pattern P(H) of light reflected by a reflective surface 22*a* of a sub-reflector 22 positioned upper right the light distribution pattern P(L)' of light reflected by the main reflector 20, as shown in FIG. 7B, when the sub-reflector 22 of the right lamp is in a high light beam forming position. For both of left and light lamps, low beam forming positions of the sub-reflectors 22 are similar to that of the above-mentioned embodiment.

At running with the low beam condition, if the vehicle goes straight, the beam irradiation with a light distribution pattern P(L) as shown in FIG. 5A, similar to the above-mentioned embodiments.

Under this condition, if a left steering is operated, the steering unit 52 generates and feeds a left steering signal to the controller 50. The controller 50 makes, on receiving the left steering signal, the sub-reflector driving unit 24 of the left lamp move the sub-reflector 22 of the left lamp to the high beam forming position. Therefore, a combined pattern of the light distribution pattern P(L)' and the additional light distribution pattern P(H) being upper left thereof is obtained, as shown in FIG. 7A. During this left steering, the sub-reflector 22 of the right lamp is maintained in the low beam forming position.

Contrary, if a right steering is operated, the steering unit 52 generates and feeds a right steering signal to the controller 50. The controller 50 makes, on receiving the right steering signal, the driving unit 24 of the right lamp move the sub-reflector 22 of the right lamp to the high beam forming position. Therefore a combined pattern of the light distribution pattern P(L)' and the additional light distribution pattern P(H) being upper right thereof, as shown in FIG. 7B. During this right steering, the sub-reflector 22 of the left lamp is maintained in the low beam forming position.

According to the embodiment described above, the beam may be widely irradiated to the vehicle running direction during the cornering. Therefore, the front side visibility may be improved under the low beam running condition.

In these cases, a switching operation by a switch 54 may make a combination pattern of the low beam light distribution pattern P(L) and the additional light distribution patterns P(H) by both left and right lamps irrespective the steering operations. In this case, more comfortable and safety drive may be carried out.

In the above described embodiments, the discharge light emitting portion of the discharge bulb serves as the light source. Instead, however, a filament of a incandescent lamp such as a halogen bulb may be used as the light source.

In the above described embodiment, the sub-reflector 22 is moved to the position where the sub-reflector 22 directs the light from the light source downward. In another embodiment described above, the sub-reflector 22 is moved to the position where the light from the light source cannot incident on the sub-reflector 22. It is not limited, and other constitutions for inhibiting the sub-reflector 22 from forwardly reflecting the light from the light source.

In the embodiments mentioned above, the solenoid is used as the sub-reflector driving unit. However, other driving units such as a pulse motor may used.

In the above described embodiments, the stationary shade blocks the light form being incident on the sub-reflector in the second position. However, it is not limited, and other constitutions for shading the light to the sub-reflector in the second position may be applicable. For instance, a shade paint or a shade film may be attached to the surface of the light bulb. Similar to the described embodiments, the sub-reflector in the second position does not contribute the light distribution function of the lamp, so that it is not necessary to finely control the stop positions for the beam switching. Therefore, the cost of the reflector driving unit may be reduced.

As apparent from the description above, the present invention may obtain, in the vehicle head lamp in which the light distribution is changed by moving the element of the vehicle head lamp, the beam irradiations with sufficient intensities wherever the element is positioned.

Although the present invention has been described by way of exemplary embodiments, it should be understood that those skilled in the art might make many changes and substitutions without departing from the spirit and the scope of the present invention which is defined only by the appended claims.

What is claimed is:

1. A vehicle head lamp for irradiating a light from a light source, said vehicle head lamp comprising:

a main reflector for reflecting the light from the light source;

a sub-reflector movable in a first position and a second position, wherein said sub-reflector forwardly reflects the light from the light source when said sub-reflector is in the first position, and said sub-reflector is inhibited from forwardly reflecting the light from the light source when said sub-reflector is in the second position; and a driving unit connecting to said sub-reflector to make said sub-reflector move between the first position and the second position.

2. A vehicle head lamp as claimed in claim 1, further comprising a shade surrounding a front portion of the light source.

3. A vehicle head lamp as claimed in claim 1, wherein said sub-reflector includes a reflective surface for reflecting the light and a back surface for prohibiting the light incident thereon form reflecting.

4. A vehicle head lamp as claimed in claim 3, wherein the back surface of said sub-reflector has steps.

5. A vehicle head lamp as claimed in claim 3, wherein an anti-reflective coating is applied on the back surface of said sub-reflector.

6. A vehicle head lamp as claimed in claim 1, wherein said sub-reflector in the first position and said main reflector form a high beam, and said sub-reflector in the second position and said main reflector form a low beam.

7. A vehicle head lamp as claimed in claim 6, wherein said driving unit includes a solenoid movable between an exciting position and a no-exciting position, wherein the exciting position where said driving unit makes said sub-reflector be in the first position, and the no-exciting position where said driving unit makes said sub-reflector be in the second position.

8. A vehicle head lamp as claimed in claim 7, wherein said driving unit further includes a return spring for urging the solenoid toward the no-exciting position.

9. A vehicle head lamp as claimed in claim 6, wherein said sub-reflector is positioned between said main reflector and the light source.

10. A vehicle head lamp as claimed in claim 6, wherein said sub-reflector shades the light reflected by a center region of said main reflector.

11. A vehicle head lamp as claimed in claim 1, wherein said sub-reflector is pivotable between the first position and the second position.

12. A vehicle head lamp as claimed in claim 1, wherein said sub-reflector is reciprocatable between the first position and the second position.

13. A vehicle head lamp attached to a vehicle which has a steering operation, said vehicle head lamp comprising:

a right head lamp for irradiating a light from a light source including, a main reflector for reflecting the light;

a sub-reflector movable in a first position and a second position, wherein said sub-reflector forwardly reflects the light from the light source when the sub-reflector is in the first position, and the sub-reflector is inhibited from forwardly reflecting the light from the light source when the sub-reflector is in the second position, and a driving unit connecting to the sub-reflector to make the sub-reflector move between the first position and the second position; and a left head lamp for irradiating a light from a light source including, a main reflector for reflecting the light, a sub-reflector movable in a first position and a second position, wherein the sub-reflector forwardly reflects the light from the light source when the sub-reflector is in the first position, and the sub-reflector is inhibited from forwardly reflecting the light from the light source when the sub-reflector is in the second position, and a driving unit connecting to the sub-reflector to make the sub-reflector move between the first position and the second position.

14. A vehicle head lamp as claimed in claim 13, further comprising a controller connecting to the driving units of said right head lamp and said left head lamp, wherein said controller controls the driving units of said right head lamp and said left head lamp based on the steering operation of the vehicle.

15. A vehicle head lamp as claimed in claim 13, further comprising a switch for individually instructing to the driving unit of said right head lamp and to the driving unit of said left head lamp.

* * * * *